US008251740B2

(12) United States Patent
Grice et al.

(10) Patent No.: US 8,251,740 B2
(45) Date of Patent: Aug. 28, 2012

(54) HDMI PLUG AND CABLE ASSEMBLY

(75) Inventors: Michael E. Grice, Fuquay Varina, NC (US); Jason Alan Skeoch, San Ramon, CA (US)

(73) Assignee: All Systems Broadband, Inc., Livermore, CA (US)

( * ) Notice: Subject to any disclaimer, the term of this patent is extended or adjusted under 35 U.S.C. 154(b) by 95 days.

(21) Appl. No.: 12/878,602

(22) Filed: Sep. 9, 2010

(65) Prior Publication Data

US 2012/0064758 A1 Mar. 15, 2012

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS

| | | | | |
|---|---|---|---|---|
| 6,079,259 | A * | 6/2000 | Starman | 73/114.45 |
| 7,455,545 | B2 | 11/2008 | Chawgo et al. | |
| 7,476,118 | B2 | 1/2009 | Amidon | |
| 7,572,139 | B2 | 8/2009 | Montena | |
| 2005/0141208 | A1 * | 6/2005 | Niinuma | 361/797 |
| 2008/0102689 | A1 * | 5/2008 | Dhir | 439/490 |
| 2009/0023329 | A1 * | 1/2009 | Mehnert et al. | 439/490 |
| 2009/0075513 | A1 | 3/2009 | Amidon | |
| 2009/0168284 | A1 * | 7/2009 | Lohr et al. | 361/92 |
| 2009/0239405 | A1 | 9/2009 | Amidon | |
| 2009/0239406 | A1 | 9/2009 | Amidon | |
| 2009/0269943 | A1 * | 10/2009 | Palli et al. | 439/39 |

OTHER PUBLICATIONS

Author Unknown. "HDMI." Excerpt from Wikipedia, printed Sep. 6, 2010, available online at: http://en.wikipedia.org/wiki/Hdmi.

* cited by examiner

*Primary Examiner* — Renee Luebke
*Assistant Examiner* — Larisa Tsukerman
(74) *Attorney, Agent, or Firm* — Murphy, Bilak & Homiller, PLLC

(57) ABSTRACT

A high-definition multimedia interface (HDMI) plug on an HDMI cable assembly includes an indicator light that is illuminated only when both ends of the cable are plugged into a video source and a video sink. Embodiments include an HDMI plug that comprises a connector body having a mating end configured for insertion into a mating HDMI receptacle and containing electrical pins configured according to HDMI specifications, the pins including a +5V Power pin, a Ground pin, and a Hot Plug Detect pin. The HDMI plug further comprises an indicator circuit that includes a light-emitting diode and a transistor switch in series with the light emitting-diode, wherein the light-emitting diode and transistor switch are coupled to the +5V Power pin, Ground pin, and Hot Plug Detect pin so that the light-emitting diode is activated only when both the +5V Power pin and Hot Plug Detect pin are energized.

5 Claims, 4 Drawing Sheets

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | CEC |
| 14 | Reserved |
| 15 | SCL |
| 16 | SDA |
| 17 | DDC/CEC Ground |
| 18 | +5V Power |
| 19 | Hot Plug Detect |

*FIG. 4*

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | TMDS Data5+ |
| 14 | TMDS Data5 Shield |
| 15 | TMDS Data5- |
| 16 | TMDS Data4+ |
| 17 | TMDS Data4 Shield |
| 18 | TMDS Data4- |
| 19 | TMDS Data3+ |
| 20 | TMDS Data3 Shield |
| 21 | TMDS Data3- |
| 22 | CEC |
| 23 | Reserved |
| 24 | Reserved |
| 25 | SCL |
| 26 | SDA |
| 27 | DDC/CEC Ground |
| 28 | +5V Power |
| 29 | Hot Plug Detect |

*FIG. 5*

HDMI PLUG AND CABLE ASSEMBLY

TECHNICAL FIELD

The present invention relates generally to cable assemblies for use with audio and video equipment.

BACKGROUND

HDMI (High-Definition Multimedia Interface) is a compact audio/video interface for transmitting digital data between equipment, such as between a satellite television receiver or a Digital Video Disc (DVD) player and a television monitor. Previous interconnection technologies, such as radio-frequency (RF) coaxial cable, composite video, S-video, etc., relied on analog transmission. HDMI provides a high-quality digital alternative.

HDMI cables have become increasingly prevalent in consumer applications. This increased deployment coincides with a general increase in complexity associated with household audio and video systems. One problem that has been noted with HDMI cables in particular is a susceptibility to poor or incomplete connections, since the HDMI connectors of standard configuration have a tendency to come loose from movement or vibration of the audio/video equipment. This problem can be quite costly. For instance, cable television operators frequently deploy technicians to consumers' homes to resolve loss-of-picture complaints that turn out to be loose connections at an HDMI port.

SUMMARY

In various embodiments of the invention, a high-definition multimedia interface (HDMI) plug on an HDMI cable assembly includes an indicator light that is illuminated only when both ends of the cable are properly plugged into a video source (e.g., a set-top box or DVD player) and a video sink (e.g., a television monitor). In particular, various embodiments are configured so that a light-emitting diode (LED) in or on the plug is activated only when both the +5V Power pin and Hot Plug Detect pin, as defined by HDMI specifications, are energized.

Accordingly, some embodiments of the present invention include an HDMI plug that comprises a connector body having a mating end configured for insertion in a longitudinal direction into a mating HDMI receptacle and containing electrical pins configured according to HDMI specifications, the electrical pins including a +5V Power pin, a Ground pin, and a Hot Plug Detect pin. The HDMI plug further comprises an indicator circuit disposed in or on the plug and comprising a light-emitting diode and a transistor switch in series with the light emitting-diode, wherein the light-emitting diode and transistor switch are coupled to the +5V Power pin, Ground pin, and Hot Plug Detect pin so that the light-emitting diode is activated only when both the +5V Power pin and Hot Plug Detect pin are energized.

In various embodiments, the electrical pins are configured to comply with specifications for Type A connectors according to the HDMI 1.0 specification, specifications for Type B connectors according to the HDMI 1.0 specification, specifications for Type C connectors according to the HDMI 1.3 specification, or specifications for Type D connectors according to the HDMI 1.4 specification.

In some embodiments, the transistor switch is an NPN transistor with its collector coupled to the cathode of the light-emitting diode, the emitter coupled to the Ground Pin, and the base coupled to the Hot Plug Detect pin through a resistor.

Of course, the present invention may be carried out in ways other than those set forth in the specific embodiments illustrated herein.

BRIEF DESCRIPTION OF THE DRAWINGS

FIG. 4 lists the electrical pin configuration for a 19-pin HDMI plug.

FIG. 5 lists the electrical pin configuration for a 29-pin HDMI plug.

DETAILED DESCRIPTION

Figure 1:
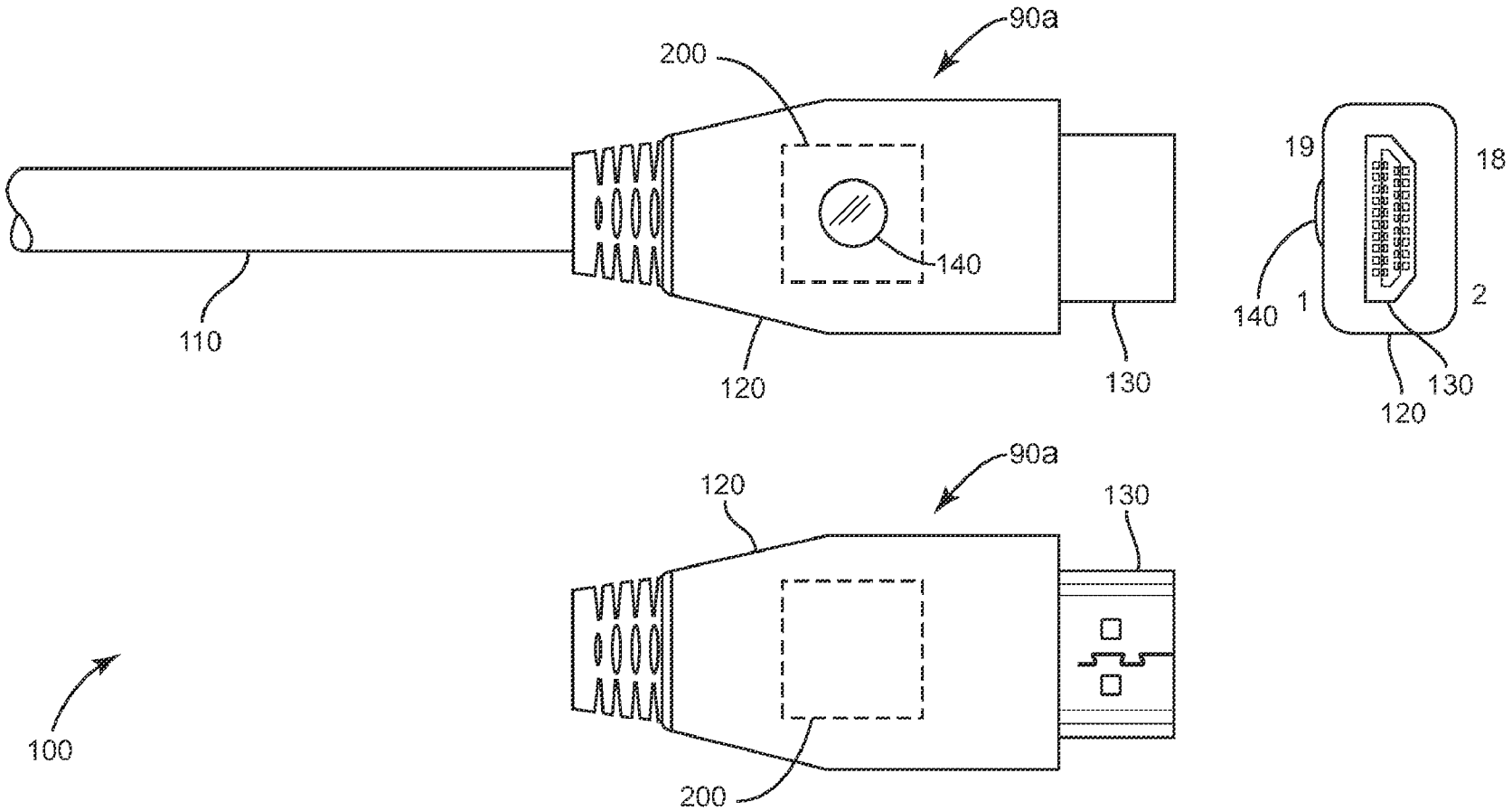
FIGS. 1 and 1*a* illustrate an HDMI cable assembly including an indicator light.

While certain embodiments of the present invention are illustrated and are described in detail below, various changes and modifications may be made without departing from the scope of the appended claims. The scope of the present invention is thus not limited to the number of constituting components, materials, shapes, relative arrangement, etc., of the example embodiments disclosed herein. Various features of the present invention are illustrated in detail in the accompanying drawings, wherein like reference numerals refer to like elements throughout the drawings.

FIG. 1 illustrates one end 90*a* of a High-Definition Multimedia Interface (HDMI) cable assembly 100 according to some embodiments of the present invention. HDMI cable assembly 100 includes a length of cable 110, a plug body 120, and a connector body 130. The cable assembly 100 further includes an indicator light 140, which in the pictured embodiment is disposed within and partly protruding from plug body 120. As discussed in further detail below, indicator light 140, which may comprise a light-emitting diode (LED), is wired to the electrical connections of the cable assembly 100 in such a manner that it illuminates only when both ends of cable assembly 100 are properly plugged in to HDMI ports of audio/video equipment.

Figure 1A:
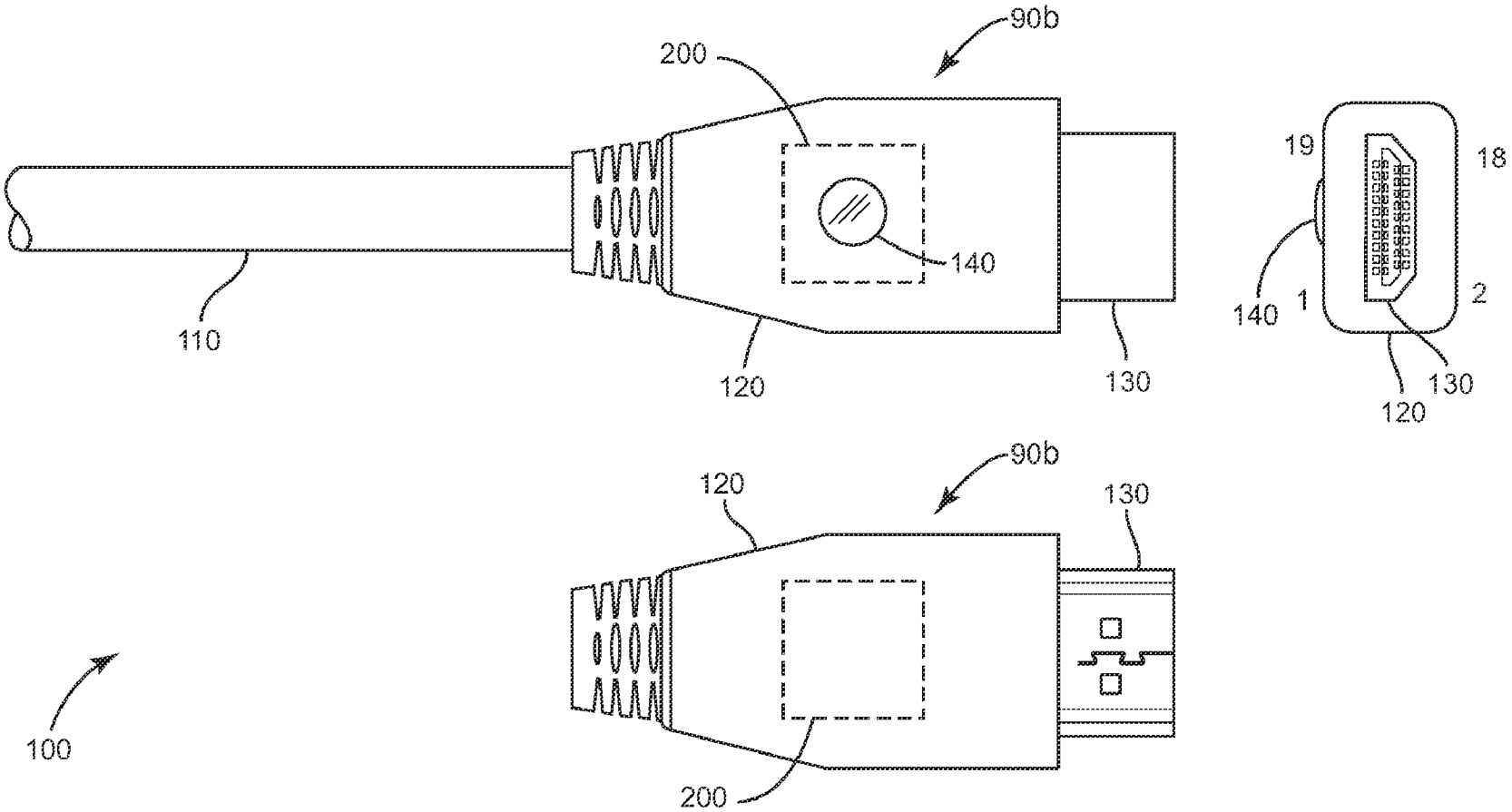

Only one end 90*a* of cable assembly 100 is illustrated in FIG. 1. The other end may terminate in a plug assembly identical to that shown in FIG. 1, in some embodiments (see, e.g., end 90*b* of FIG. 1*a*). In others, the other end of cable assembly 100 may be terminated with a different plug, with or without an indicator light 140. For instance, the plug assembly pictured in FIG. 1 may correspond to a Type A HDMI plug (with dimensions of about 13.9 mm×4.45 mm), while the other end of cable assembly 100 may be terminated with a Type C (10.42 mm×2.42 mm) or Type D (6.4 mm×2.8 mm) connector. In still other embodiments the other end of cable assembly 100 may be terminated in a proprietary (i.e., non-standard) connector configuration, for attachment to a particular type of audio or video equipment.

The cable 110 may be of various constructions and qualities. In some embodiments, cable 110 is designed to meet standards specified in the HDMI 1.3 specification for Category 1-certified cables (typically marketed as "Standard" cables) or for Category 2-certified cables (typically marketed as "High Speed" cables). Plug body 120 may be formed from injection-molded rubber, in some embodiments, and securely holds the metallic connector body 130. Connector body 130, in turn, contains nineteen electrical pins in the embodiment pictured in FIG. 1, which may correspond to a Type A or Type C plug, as specified in the HDMI 1.0 and 1.3 specifications, respectively. Other configurations are possible, including the 29-pin Type B plug specified in the HDMI 1.0 specification, and the Type D plug described in the HDMI 1.4 specification.

Figure 2:
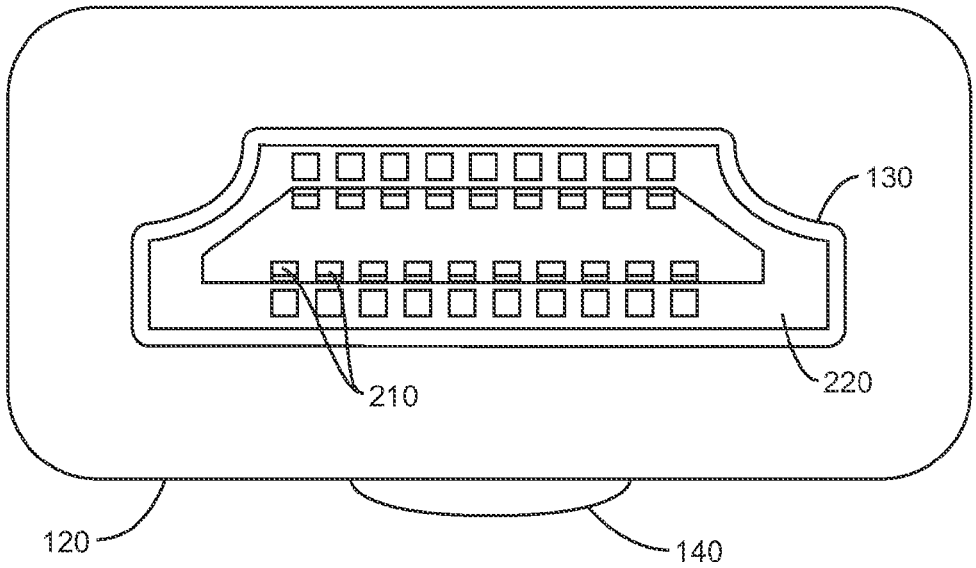
FIG. 2 is an end view of an HDMI plug.

A closer view of the mating end of the connector body 130 is illustrated in FIG. 2. As shown, connector body 130 houses plug terminal contacts 210 configured to physically and electrically contact corresponding contacts of a typical high-definition multimedia interface receptacle. The illustrated embodiment includes nineteen such terminal contacts, as in either a typical Type A or a typical Type C HDMI connector. Connector body 130 includes an inner section 220, which may be integrally formed with, separately joined to, or removably secured within an outer metallic portion of connector body 130. The plug terminal contacts 210 may be integrally formed as part of the inner section 220, may be separately joined to the inner section 220, or may be removably secured to the inner section 220. The inner section 220 may be formed of conductive materials or of a dielectric material.

FIG. 4 shows the designations for each of the nineteen pins of a Type A or Type D HDMI connector. A Type C connector includes the same electrical connections, but is configured differently. In particular, all positive signals of the differential pairs (e.g. TMDS Data2+ are swapped with their corresponding shields, the DDC/CEC Ground is assigned to pin 13 instead of pin 17, the CEC is assigned to pin 14 instead of pin 13, and the reserved pin is 17 rather than pin 14. FIG. 5 shows the electrical designations for each of the twenty-nine pins of a Type B connector.

Of particular interest with regards to the present invention are the +5V Power pin and the Hot Plug Detect pin, pins 18 and 19 of the Type A and Type D connectors. In operation, the +5V Power pin carries up to 50 milliamps of current supplied by the transmitting device (e.g., a video source such as a set-top box or DVD player). Thus, if the +5V Power pin is energized, this indicates that a source device is connected. In contrast, the Hot Plug Detect signal indicates that a display device (receiving device) is connected. Thus, if both the +5V Power pin and the Hot Plug Detect pin are energized, this indicates that the HDMI cable has been successfully plugged into a high-definition video source and a corresponding display device.

Figure 3:
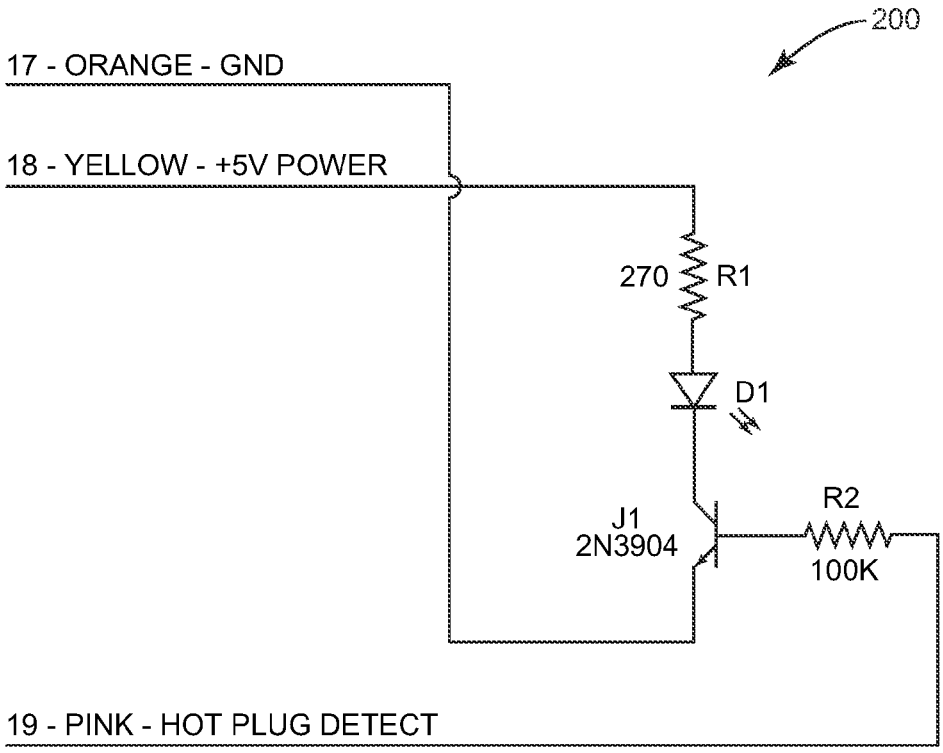
FIG. 3 is a schematic diagram of an indicator circuit according to some embodiments of the present invention.

These signals can thus be used to activate an indicator light to signal a user that the HDMI cable has been properly installed. FIG. 3 illustrates an example circuit 200 for this purpose, and includes an indicator light D1 and a switching transistor J1. In the pictured circuit 200, D1 is a light-emitting diode (LED), which may be of any commercially available color, and J1 is a general-purpose NPN transistor. The circuit 200 of FIG. 3 further includes current-limiting resistors R1 and R2. Some packaged LEDs may include an integral current-limiting resistor, which may be used instead of or in addition to a separate resistor.

The emitter of transistor J1 is connected to a ground pin, e.g., pin 17 of a Type A connector. The base of transistor J1 is coupled to the Hot Plug Detect signal (pin 19 of the Type A connector) through resistor R2. The anode of LED D1 is coupled to the +5V Power pin (pin 18 of the Type A connector) through resistor R1. Accordingly, if the Hot Plug Detect signal is high (e.g., greater than about 0.6 volts above ground) and the +5V Power pin is energized, then transistor J1 is in its forward active state and current flows through LED D1, turning the indicator light on. On the other hand, if either the Hot Plug Detect signal or the +5V Power pin is not active, then no current flows through LED D1 and the indicator light is off. The current flowing through the LED D1 can be set by an appropriate choice of resistors R1 and R2.

It will be appreciated that the circuit 200 illustrated in FIG. 3 is but one of several circuits that can be configured so that a light-emitting diode is activated only when both the +5V Power pin and Hot Plug Detect pin are energized. Other circuits may use different types of switching transistors, for example, such as a field-effect transistor (FET). In other circuits, a switching device may be located on the opposite side (the "high side) of the LED D1. In each of these configurations, however, the switching transistor and the LED are arranged so that the LED is activated only when both the +5V Power pin and the Hot Plug Detect pin are energized, and not when only one of these signals is active.

The circuit 200 of FIG. 3, or an equivalent circuit, may be implemented using any of a variety of conventional wiring techniques. In some embodiments, resistors R1 and R2, transistor J1, and LED D1 may be leaded components, installed in a printed circuit board according to conventional printed circuit board assembly techniques. Other embodiments may use one or more surface mount components. In either case, the printed circuit board assembly in such embodiments includes connections to the appropriate pins of the HDMI connector; these signals are passed through the printed circuit board or bypassed around the circuit board to the appropriate wires of the cable. The printed circuit board in turn may be housed within an injection-molded plug body. Of course, other physical configurations are possible, such as a printed circuit board assembly contained within a snap-together, modular, plug body that also captures the connector body 130.

It should be noted that while FIG. 3 illustrates wiring to pins 17, 18, and 19 of a 19-pin Type A connector, a similar circuit may be attached to corresponding pins of a 29-pin Type B connector, or to corresponding pins of a Type C or D connector. In some embodiments, an indicator circuit like the one pictured in FIG. 3 may be included at both ends of an HDMI cable assembly (see, e.g., FIGS. 1 and 1*a*), while in others the indicator circuit may appear only at one end. It will be appreciated that in either case, the indicator light or lights are activated only when both ends of the HDMI cable are plugged into HDMI receptacles for a video source and display, thus indicating that the signal path between the video source and the video sink is sufficiently terminated to pass audio and video signals. However, one advantage of the circuit configuration of the present invention is that it does not require that the cable be "polarized"—assuming compatible connector types, either end of the cable can be plugged into either the video source or the video sink.

The circuit 200 of FIG. 3, coupled with the cable assembly illustrated in FIGS. 1 and 2, illustrates one example of an HDMI plug according to the present invention. Generally speaking, such a plug includes a connector body having a mating end configured for insertion in a longitudinal direction into a mating HDMI receptacle and containing electrical pins configured according to HDMI specifications, the electrical pins including a +5V Power pin, a Ground pin, and a Hot Plug Detect pin. The plug further includes an indicator circuit, such as the circuit 200, disposed in or on the plug and including a light-emitting diode and a transistor switch in series with the light emitting-diode, wherein the light-emitting diode and transistor switch are coupled to the +5V Power pin, Ground pin, and Hot Plug Detect pin so that the light-emitting diode is activated only when both the +5V Power pin and Hot Plug Detect pin are energized. Other embodiments of the present invention include an HDMI cable assembly comprising a cable and first and second HDMI plugs, each of which includes a circuit like that described above.

Of course, the techniques of the present invention may be carried out in ways other than those set forth in the specific embodiments illustrated herein. Thus, the present invention is not limited to the features and advantages detailed in the foregoing description, nor is it limited by the accompanying drawings.

What is claimed is:

1. A high-definition multimedia interface (HDMI) plug comprising:

a connector body having a mating end configured for insertion in a longitudinal direction into a mating HDMI receptacle and containing electrical pins configured according to HDMI specifications, the electrical pins including a +5V Power pin, a Ground pin, and a Hot Plug Detect pin; and an indicator circuit disposed in or on the plug and comprising a light-emitting diode and a transistor switch in series with the light emitting-diode, wherein the light-emitting diode and transistor switch are coupled to the +5V Power pin, Ground pin, and Hot Plug Detect pin so that the light-emitting diode is activated only when both the +5V Power pin and Hot Plug Detect pin are energized.

2. The HDMI plug of claim 1, wherein the electrical pins are configured according to one of the following:

specifications for Type A connectors according to the HDMI 1.0 specification;

specifications for Type B connectors according to the HDMI 1.0 specification;

specifications for Type C connectors according to the HDMI 1.3 specification; and specifications for Type D connectors according to the HDMI 1.4 specification.

3. The HDMI plug of claim 1, wherein the transistor switch comprises an NPN transistor having a base, emitter, and collector, and wherein the collector is coupled to the cathode of the light-emitting diode, the emitter is coupled to the Ground Pin, and the base is coupled to the Hot Plug Detect pin through a resistor.

4. A high-definition multimedia interface (HDMI) cable assembly comprising a cable and first and second HDMI plugs, each of the first and second HDMI plugs comprising:

a connector body having a mating end configured for insertion in a longitudinal direction into a mating HDMI receptacle and containing electrical pins configured according to HDMI specifications, including a +5V Power pin, a Ground pin, and a Hot Plug Detect pin; and an indicator circuit disposed in or on the plug and comprising a light-emitting diode and a transistor switch in series with the light emitting-diode, wherein the light-emitting diode and transistor switch are coupled to the +5V Power pin, Ground pin, and Hot Plug Detect pin so that the light-emitting diode is activated only when both the +5V Power pin and Hot Plug Detect pin are energized.

5. The HDMI cable assembly of claim 4, wherein, in each of the first and second HDMI plugs, the transistor switch comprises an NPN transistor having a base, emitter, and collector, and wherein the collector is coupled to the cathode of the light-emitting diode, the emitter is coupled to the Ground Pin, and the base is coupled to the Hot Plug Detect pin through a resistor.

* * * * *